United States Patent [19]

Parcher

[11] Patent Number: 4,794,662

[45] Date of Patent: Jan. 3, 1989

[54] REMOTELY OPERATED CHIMNEY CLEANING APPARATUS

[76] Inventor: Randy B. Parcher, 2588 Carlson Rd., Sidney, Mich. 48885

[21] Appl. No.: 97,102

[22] Filed: Sep. 16, 1987

[51] Int. Cl.[4] ..... B66D 3/24

[52] U.S. Cl. ..... 15/163; 15/243; 212/223; 212/248

[58] Field of Search ..... 15/163, 162, 242, 243, 15/249; 212/247, 248, 223, 245; 414/10; 254/329, 332

[56] References Cited

U.S. PATENT DOCUMENTS

| | | | |
|---|---|---|---|
| 1,140,225 | 5/1915 | Wilson | 15/243 |
| 3,019,918 | 2/1962 | Keener | 212/248 |
| 4,505,000 | 3/1985 | Boehland et al. | 15/249 |

FOREIGN PATENT DOCUMENTS

| | | | |
|---|---|---|---|
| 2256637 | 7/1975 | France | 15/163 |
| 1147512 | 6/1983 | France | 15/163 |
| 25637 | of 1909 | United Kingdom | 15/249 |

*Primary Examiner*—Timothy F. Simone
*Assistant Examiner*—J. Dwight Poffenberger, Jr.
*Attorney, Agent, or Firm*—Krass & Young

[57] ABSTRACT

The invention is a self-contained chimney cleaning apparatus. A winch operated wire brush is attached by cable to a winch pulley, which is in turn mounted to a pivoting housing. The pivoting housing is suspended over the opening of the chimney flue, and remotely controllable. The remote control allows the housing to be pivoted away from the chimney flue opening when the cleaning operation is complete. During the cleaning operation, the housing is positioned over the chimney flue opening and the winch operated brush is lowered and raised through the chimney flue.

6 Claims, 2 Drawing Sheets

REMOTELY OPERATED CHIMNEY CLEANING APPARATUS

FIELD OF THE INVENTION

This invention relates to an apparatus for cleaning chimneys and flues, and more particularly, to a remotely operated, electrically powered apparatus which is removably attached to the external portion of the chimney or flue exterior structure.

BACKGROUND OF THE INVENTION

In today's energy conscious society, there has been a substantial shift in emphasis toward alternate energy sources, including a renewed interest in wood and coal for residential and commercial applications. This resurgence of interest has resulted in substantially increased risk to structures and their occupants as a result of the natural deposit of the products of combustion of organic fuels such as wood and coal on the inner surfaces of the flues and chimneys serving to exhaust the combustion waste gases from stoves, furnaces and fireplaces.

In the typical methods of solving this problem, such flues and chimneys must be manually cleaned by regular scheduled scrubbing of the inner surface of the chimneys and flues with portable equipment, such as wire brushes, suitable designed to accomplish this cleaning task.

Because of the design of such flues and chimneys, this cleaning task invariably requires access to the chimney at its upper end. This involves substantial climbing by individuals to dangerous heights above the ground, the use of a series of ladders, ropes, safety wires, guides and associated apparatus. The procedure is both expensive and time consuming, and, as a result, it is a procedure which is often neglected by the property owner, resulting in increased risk of fire in the flue or chimney, as well as degradation of the performance of the heating plant as a result of the obstruction of the exhaust openings.

To overcome these problems, the invention herein disclosed is an apparatus allowing for the regular cleaning of flues and the like by virtue of a removably mounted remotely operated chimney cleaning device.

SUMMARY OF THE INVENTION

The invention consists of a container which is pivotably mounted to a support, which support is permanently affixed to the upper end of the chimney of flue. The pivotably mounted container is disposed upon the chimney so as to allow said pivotably mounted container to be pivoted directly over the chimney or flue opening for purposes of operating the cleaning mechanism mounted within said container and, when the cleaning operation is completed, pivoting the container away from the open end of the chimney to facilitate exhaust of combustion by-products through the chimney or flue.

Located within the container are two electric motors, which are connected through suitable step-down gear devices, one of which operates a mechanism for pivoting the complete container unit in position over the chimney opening, and another for operating a winch on which is mounted a length of flexible cable, to which is affixed, at one end, a chimney cleaning brush device and a suitable weight.

The operation of the pivoting motor and winch motor are remotely controlled and regulated by limit switches, also located within the container.

Within the container is a horizontally mounted winch and spool, the spool being mounted with its rotational axis more or less parallel to the surface of the earth. Coiled on said spool is a suitable length of strong cable, capable of supporting the weight of a chimney cleaning brush and drag weight, and of overcoming the forces necessary to draw the brush and weight up through the chimney flue, notwithstanding a tight friction fit between said brush and said flue.

The electric motors operating the apparatus are controlled, via a cable assembly, by a remotely mounted switch panel, which may include indicator light to designate the status of the position of the container and the position of the chimney cleaning brush and weight combination mounted on the cable supported by the spool within the container.

DETAILED DESCRIPTION OF THE DRAWINGS

DETAILED DESCRIPTION OF THE PREFERRED EMBODIMENT

Figure 1:
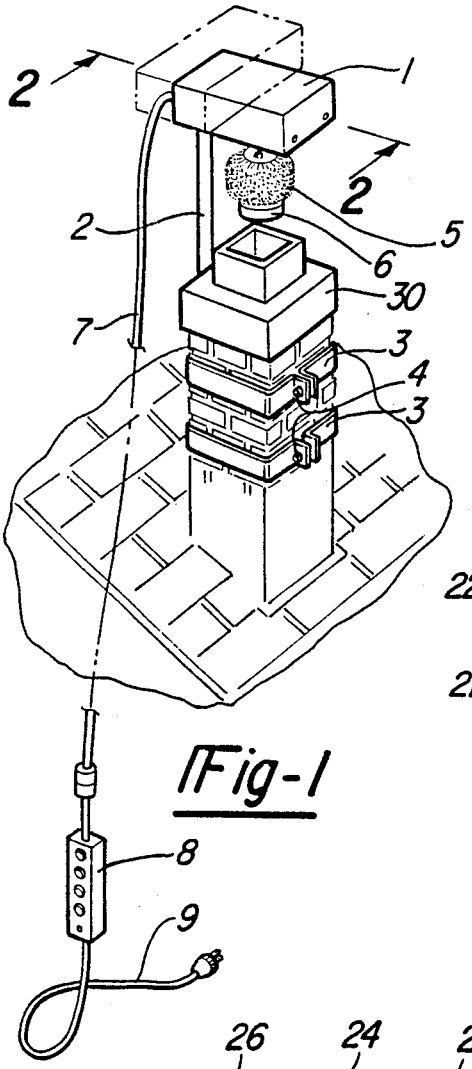
FIG. 1 is a perspective view of the invention, showing the mounting means, the container for the actuators, the control and power cable, the chimney brush and weight, the control switch box and power cord outlet.

Referring now to FIG. 1, a perspective sketch of a typical residential home roof and chimney is presented.

In the preferred embodiment, a housing 1 is pivotally mounted on a pivot support 2, which in turn is fixed to as least one strap 3 which is secured about the chimney structure 30 using fasteners 4. A brush 5 and weight 6 are suspended by a cable from the housing 1. The internal electrical components of the housing 1 are powered via multiple conductors contained in power cable 7, which are operated through a control box 8, which derives its power from a power cord 9 adapted for use in a conventional household wiring setting, and a conventional commercially available power outlet found in the residential setting.

Figure 2:
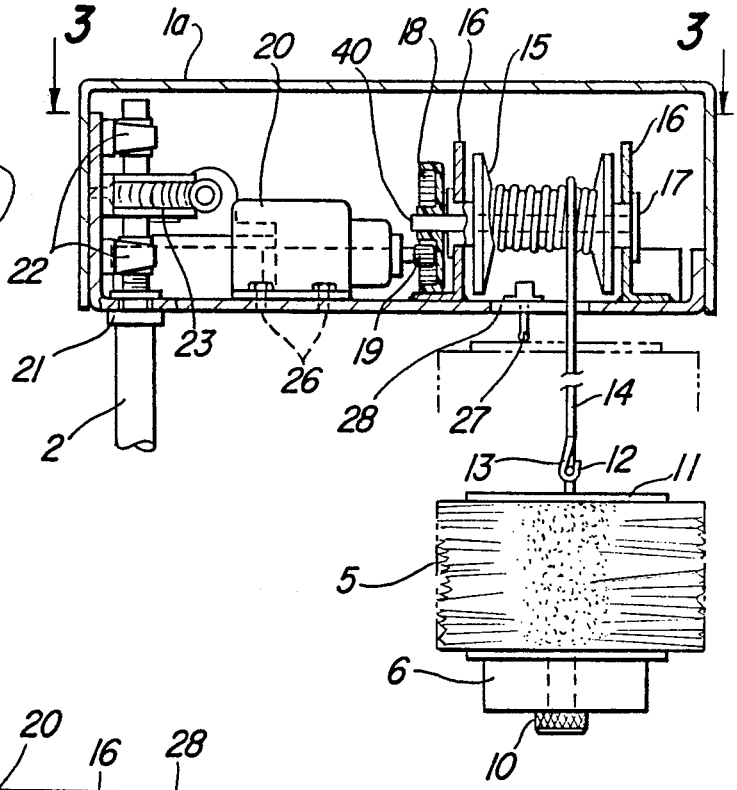
FIG. 2 is a cut-away side view of the actuator container and a side view of the upper portion of the mounting axle and chimney brush/weight combination.

Referring now to FIG. 2, it can be seen that the housing 1 is constructed of two separate components, a housing top 1*a* and a housing bottom 1*b*. The housing top 1*a* is constructed of a durable material such as metal or plastic and comprises a five-sided container open at the bottom. The housing bottom 1*b* is likewise in the form of a five-sided container, having substantially shallower side walls, however, in comparison to housing top 1*a*. However, on one side of the five-sided container comprising the housing bottom 1*b*, a longer side wall is constructed for purposes of mounting portions of the additional components.

The housing 1 is mounted to the pivot support 2 by means of pivot support connectors 22. Mounted on the housing bottom 1*b* are a pair of winch brackets 16 on which is mounted, by virtue of a pair of bearings 17, a winch pulley 15. The winch pulley 15 is coupled by virtue of an axle 40 which is fixed to a winch driven gear 18. Attached to the center section of the winch is a cable 14 of sufficient length to allow the cable, when fully extended, to reach the entire length of the internal wall of the chimney flue.

A motor 20 is attached with fasteners 26 to the housing bottom 1*b*, and the output shaft of said motor is equipped with a motor driving gear 19 which meshes with the winch driven gear 18, thereby supplying a source of rotational power to the winch driven gear and the winch. The winch motor 20 is reversible in operation, and electrically connected through a wiring harness to the power cable 7. A chimney cleaning brush 5 is mounted on a brush holder 11 which is also equipped with brush holder attachment means 12. A winch cable connector 13 allows installation and removal of the assembly consisting of the brush holder 11, brush 5, brush weight 6, and brush holder assembly nut 10 as a unit. A brush weight 6 is removable from the brush holder 11 to allow a wide variety of weights to be used with the same basic cleaning apparatus assembly, based on the size and shape of the chimney flue as well as the size and shape of the brush. The brush and holder and weight combination are held together by brush assembly nut 10.

The entire brush holder, brush and weight assembly are moved vertically through the center of the chimney flue by virtue of the rotational motion of the winch 15 winding and unwinding the cable 14 around the winch axle. The travel of the brush and cable assembly are limited by a limit switch 28, which is actuated by limit switch plunger 27, which reverses the direction of the motor upon closure.

Figure 3:
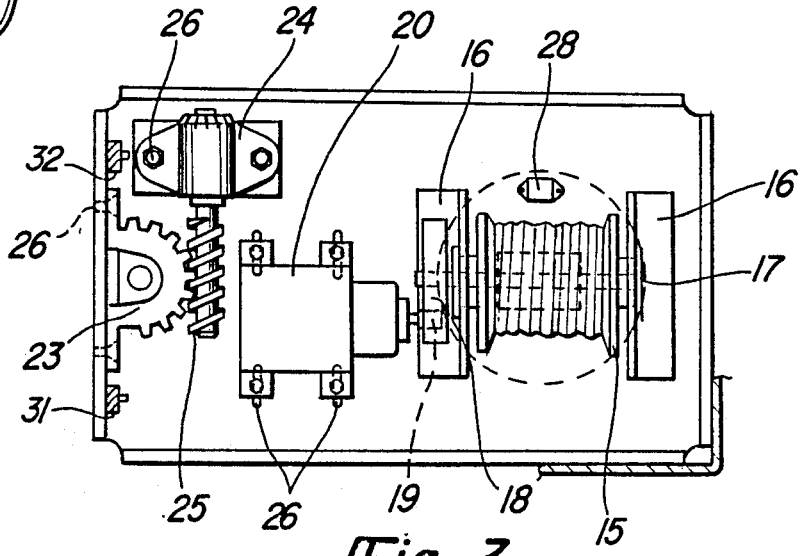
FIG. 3 is a top cut-away view of the actuator container.

Referring now to FIG. 3, a housing pivot motor 24 is secured to the housing bottom 1b by virtue of fasteners 26. The output shaft of the housing pivot motor 24 is equipped with a worm gear 25, and the housing pivot motor is so affixed to the base of the housing 1b so as to cause said worm gear to mesh with a hemispherical gear 23 mounted on pivot support 2 inside of housing 1. Limit switches 31 and 32 serve to contact the edge of the motor 24 housing and the end of the worm gear 25, when the housing is at its maximum travel limits. The motor operations are controlled by virtue of electrical signals supplied through a power cable 7.

Figure 4:
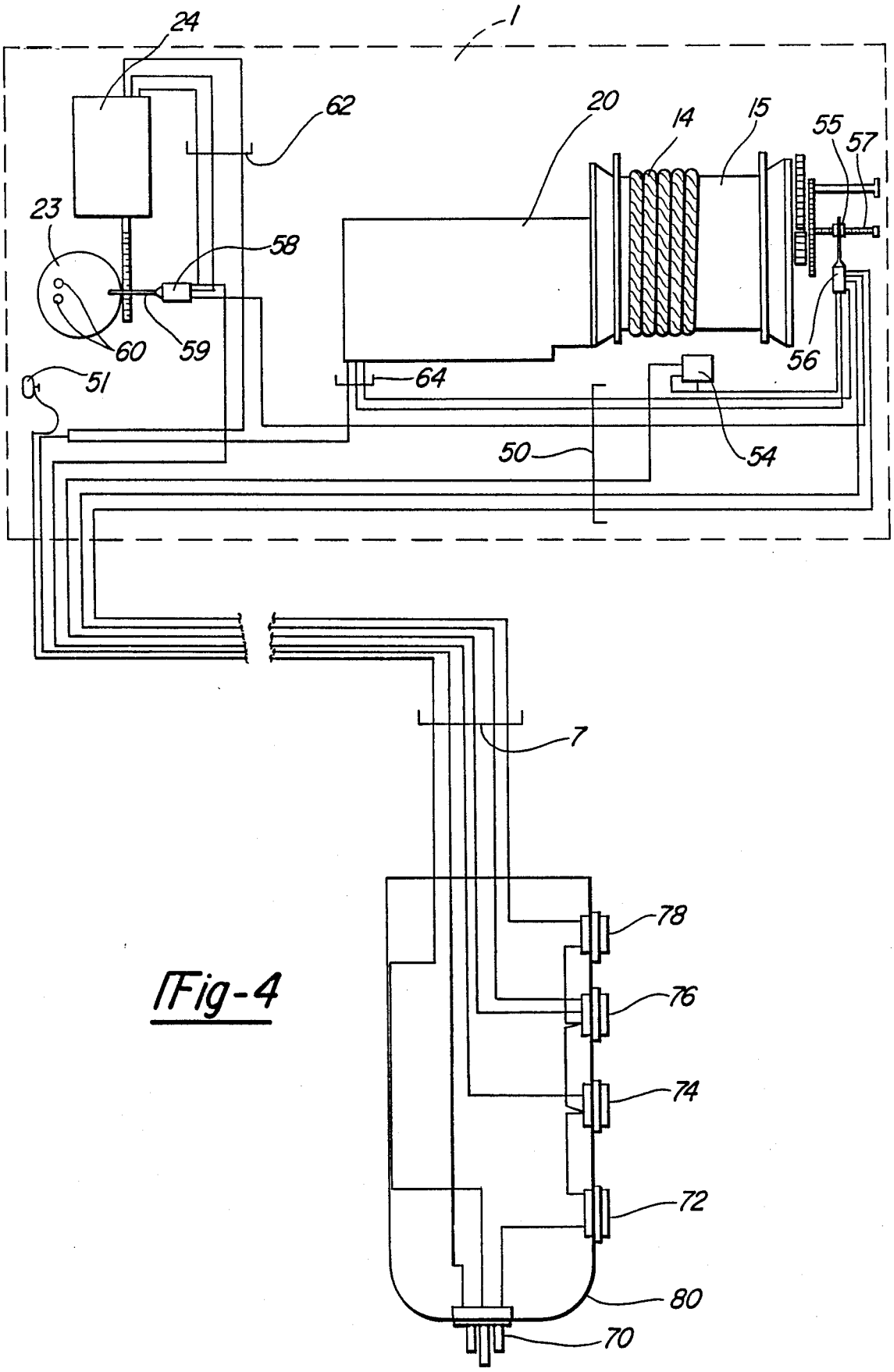
FIG. 4 is a schematic diagram of an alternative embodiment of the circuitry.

Referring now to FIG. 4, a schematic of the associated electrical circuitry operating the apparatus is shown. This figure depicts an alternative embodiment of the limit switch arrangement previously described, in addition to the electrical circuitry.

Conventional household AC current is provided to a grounded male connector 70. The earth or ground connection is secured to a ground screw 51 inside the housing 1. One connector of the AC line provides an uninterrupted connection to the common pole of motors 20 and 24. The remaining AC line is connected through a series of switches to activate the winch motor 20 and pivot motor 24, regulated by a series of limit switches as hereinafter described.

The operating switch housing 80 is equipped with four switches. Power switch 72 is a two position, on-off switch serving to supply and interrupt a power to the remainder of the circuitry. The output of switch 72 is fed to switches 74, 76 and 78. Switch 74 is the housing rotation switch. When activated, switch 74 ensures a completed electrical circuit and supply of AC power to the clockwise rotation of pivot motor 24, driving the output shaft of motor 24 in a clockwise direction, thereby rotating housing 1 in a similar clockwise direction. Switch 74 is a momentary switch which must be held in position to ensure a continued supply of current to pivot motor 24.

An alternative embodiment to the two limit switches 31 and 32 for preventing the over rotation of the housing is envisioned. Interposed in the above-described circuit is double-throw switch 58, the position of which is controlled by toggle lever 59. When the toggle lever is in either extreme position, the switch 58 sends current to motor 24 through the poles of switch 58 which are closed by the operation of lever 59. As the housing 1 rotates, hemispheric gear 23 (shown in a simplified outline) moves with simultaneously with housing 1. Located on the underside of hemispheric gear 23 are two pins 60, so placed as to engage switch lever 59 at the extreme ends of the rotational travel of housing 1 as it pivots around hemispheric gear 23. Upon reaching the end of the travel, lever 59 is actuated by pin 60, thereby switching the source of electrical current to the alternate pole of motor 24, changing the direction of rotational travel of the output shaft of motor 24 counterclockwise. Upon reaching the full limit of the counterclockwise rotation of housing 1 about hemispheric gear 23, the pins 60 similarly forces lever 59 to the opposite position, again switching the current output from switch 58. In this method, the housing is prevented from traveling beyond the rotational limits set by the arc defined by the position of pins 60.

Motor 20 is operated in a similar fashion, with up-down motion of the winch being switch-selectable through single pole, double-throw switch 76, and motor operation regulated through a momentary contact switch 78. In the preferred embodiment, directionality of the winch motor is regulated by the position of switch 76, and operation of the motor is regulated by switch 78.

However, to ensure against overwinding of the winch and overloading the winch motor a safety mechanism is utilized. An alternative embodiment to the FIG. 2 limit switch 28 and limit switch plunger 27 is herein envisioned. Safety cut-off switch 54 is located so as to sense the extreme position of the brush holder mechanism, and a second safety limit switch 56 regulates the total travel of the winch gear by virtue of a traveler 55 moving along worm gear 57 which derives its output from the axle of winch 15. The closure of switch 54 results in transfer of the power supply to winch motor 20 to the opposite motor input line by virtue of the position of switch 56 as regulated by the position of the follower 55 on the worm gear 57. In this fashion, the position of the brush is always ensured to be outside the housing and clear of the winch 15.

In operation, therefore, the operator at the remote location holds control box 8 and depresses the first switch, thereby moving the entire housing assembly A from position A to position B. Operation of the control box switch energizes housing pivot motor 24, which in turn operates the worm gear 25, engaging the hemisphere gear 23 and rotating the housing 1 into position over the opening of the chimney 30. Upon reaching its limit, switch 58 terminates the rotation of housing 1 and enables the control box switch for rotation in the opposite direction, when required.

Having thereby positioned the housing 1 over the chimney opening, the operator then engages the second function of the control box, energizing the winch motor, therefore allowing the cable 14 to play out from the winch 15, lowering the chimney brush and brush holder assembly into the opening of the chimney 30. Upon reaching the end of the cable, the cable will immediately begin winding in the reverse direction around the winch 15, thereby raising the brush assembly upward through the chimney opening and performing a second cleaning operation. The brush, upon reaching its upper limit, will in the embodiment depicted in FIG. 2 depress plunger 27, thereby activating switch 28 and de-energizing the winch motor 20. Similarly, in the embodiment of FIG. 4, switch 54, traveler 55 and worm gear 57 perform the similar task as previously described, when the traveler 55 reaches its limit of travel. The cycle may be repeated as often as necessary. Upon completion of the cleaning cycle, the operator again operates a control on control box 8, thereby reenergizing the housing pivot motor in the opposite direction from the first operation of the housing pivot motor 24 and pivoting the housing back to position A, clear of the chimney exhaust fumes.

Having thus disclosed my invention in detail, it may be seen that numerous obvious modifications may be made thereto without departing from the spirit or scope of the invention herein claimed, which is:

1. An apparatus for cleaning chimney and flue openings, comprising a pivot support, means to attach said pivot support to the exterior of a chimney or stovepipe, an enclosure pivotably mounted on one end of said support, said enclosure further comprising:

(A) a hemispherical gear attached to said pivotal support within said enclosure;
(B) a worm gear engageable with said hemispherical gear;
(C) a first reversible electric motor mounted within said enclosure;
(D) means for attachment of said worm gear to the output shaft of said first electric motor;
(E) a second reversible electric motor mounted within said enclosure;
(F) a winch mounted within said enclosure;
(G) means for the operating of said winch by said second electric motor;
(H) a cable;
(I) means for attachment of one end of said cable to said winch;
(J) a brush;
(K) means to removably attach said brush to the opposite end of said cable from its point of attachment to said winch;
(L) a weight attached to said brush;
(M) means for remotely controlling the operation of said first and second electric motor; and
(N) means for limiting the operation of said first reversible electric motor.

2. The apparatus of claim 1, wherein said means for remotely controlling the operation of said first and second electric motors further comprises a multiplicity of electrical switches, a source of electrical power connected to said switches, and a series of electrical connectors connecting at least two of said switches to said first electric motor, and at least two of said switches to said second electric motor.

3. The invention of claim 1, wherein said means for limiting the operation of said first reversible electric motor further comprises first limit switch contacting surface disposed on said first reversible electric motor housing, and second limit switch contacting means disposed on the end of said worm gear opposite said worm gears point of attachment to the output shaft of said first electric motor, said limit switches and limit switch contacting surfaces being so disposed as to effect closure of said first limit switch at one extreme of the travel of said enclosure about said pivot support, and said second limit switch and said second limit switch contacting surface being disposed so as to effect closure of said limit switch at the opposite end of the travel of said enclosure about said pivot support.

4. An apparatus according to claim 1, wherein said apparatus further comprises winch limit switching means protruding downward through the bottom of said enclosure and having associated therewith limit switch contacting means disposed so as to contact the upper surface of said brush at the upper limit of the travel of said brush in relationship to said housing.

5. An apparatus according to claim 1, wherein said apparatus further comprises winch limit switching means comprising a worm gear and follower attached to said winch and controlling a limit switch reversing the polarity of said second reversible electric motor.

6. The invention of claim 1, wherein said means for limiting the operation of said first reversible motor further comprises at least one pin located on said hemispherical gear which engages a toggle lever at the rotational limit of said hemispherical gear, said toggle lever being attached to a switch which changes both the polarity of said first reversible electric motor and direction of rotation of the hemispherical gear.

* * * * *

UNITED STATES PATENT AND TRADEMARK OFFICE

CERTIFICATE OF CORRECTION

PATENT NO. : 4,794,662

DATED : January 3, 1989

INVENTOR(S) : Randy B. Parcher

It is certified that error appears in the above-identified patent and that said Letters Patent is hereby corrected as shown below:

Sheet 1 of drawing, Figure 2, bottom portion should be labeled -- 1b --.

Signed and Sealed this

Twenty-sixth Day of September, 1989

*Attest:*

DONALD J. QUIGG

*Attesting Officer*

*Commissioner of Patents and Trademarks*